US009127672B2

(12) United States Patent
Nirasawa et al.

(10) Patent No.: US 9,127,672 B2
(45) Date of Patent: Sep. 8, 2015

(54) GEAR PUMP

(75) Inventors: Hideo Nirasawa, Wako (JP); Shigeru Kanehara, Wako (JP); Shinichi Hirai, Wako (JP); Kosuke Yamane, Isesaki (JP); Masahiko Shinohara, Isesaki (JP)

(73) Assignees: HONDA MOTOR CO., LTD., Tokyo (JP); YAMADA MANUFACTURING CO., LTD., Gunma (JP)

( * ) Notice: Subject to any disclaimer, the term of this patent is extended or adjusted under 35 U.S.C. 154(b) by 62 days.

(21) Appl. No.: 13/516,141

(22) PCT Filed: Dec. 9, 2010

(86) PCT No.: PCT/JP2010/072146

§ 371 (c)(1),
(2), (4) Date: Jun. 14, 2012

(87) PCT Pub. No.: WO2011/074477

PCT Pub. Date: Jun. 23, 2011

(65) Prior Publication Data

US 2012/0251371 A1 Oct. 4, 2012

(30) Foreign Application Priority Data

Dec. 15, 2009 (JP) ..... 2009-284481

(51) Int. Cl.
*F04C 2/00* (2006.01)
*F04C 2/10* (2006.01)

(52) U.S. Cl.
CPC ..... *F04C 2/102* (2013.01); *F04C 2230/41* (2013.01); *F04C 2230/92* (2013.01); *F04C 2270/16* (2013.01); *F05C 2251/10* (2013.01)

(58) Field of Classification Search
CPC .... F04C 2/10; F04C 2230/92; F04C 2230/91; F04C 2/084; B62D 5/097
USPC ..... 418/170, 171, 166; 417/410.4
See application file for complete search history.

(56) References Cited

U.S. PATENT DOCUMENTS

| | | | | |
|---|---|---|---|---|
| 5,364,250 | A * | 11/1994 | Aoki et al. | 418/201.1 |
| 5,997,262 | A * | 12/1999 | Finkbeiner et al. | 417/410.4 |
| 6,884,049 | B2 * | 4/2005 | Hida et al. | 418/178 |

FOREIGN PATENT DOCUMENTS

| | | | |
|---|---|---|---|
| EP | 0378009 | A2 | 7/1990 |
| EP | 0533950 | A1 | 3/1993 |
| EP | 0907023 | A1 | 4/1999 |
| EP | 1643127 | A2 | 4/2006 |
| JP | 8-144964 | A | 6/1996 |
| JP | 2005-214140 | A | 8/2005 |
| JP | 2007-177735 | A | 7/2007 |
| JP | 2009013832 | A | 1/2009 |

OTHER PUBLICATIONS

European Extended Search Report dated Dec. 3, 2013, European Application No. 10837505.6, 5 pages.
Chinese Office Action issued Mar. 5, 2014; Chinese Application No. 201080056168.4.

* cited by examiner

*Primary Examiner* — Thomas Denion
*Assistant Examiner* — Thomas Olszewski
(74) *Attorney, Agent, or Firm* — Arent Fox LLP

(57) ABSTRACT

In a gear pump in which a driving rotor that is driven by a driving source meshes with a driven rotor that is driven by the driving rotor for rotation to pump a hydraulic oil, only one of the driving rotor and the driven rotor is given the steam treatment while the other remains untreated.

1 Claim, 2 Drawing Sheets

GEAR PUMP

CROSS-REFERENCED TO RELATED APPLICATION

This application is a National Stage entry of International Application PCT/JP2010/072146, filed Dec. 9, 2010, which claims priority to Japanese Patent Application No. 2009-284481, filed Dec. 15, 2009, each of the disclosures of the prior applications being hereby incorporated in their entirety by reference.

TECHNICAL FIELD

The present invention relates to a gear pump that is used as an automotive oil pump and so on, and particularly to a technology of surface treatment on the rotor contacting surface of the gear pump.

BACKGROUND ART

Patent Document 1 below discloses that, in a gerotor pump, contacting surfaces of both of an inner rotor and an outer rotor are given a surface treatment to be coated with a carbide or nitride film to improve abrasion resistance. Also, as a treatment of the contacting surfaces of both of the inner rotor and the outer rotor, a steam treatment has conventionally been known. Meanwhile, Patent Document 2 below discloses a configuration in which an entire surface of one of rotors is coated with a soft material having a self-lubricating property and an entire surface of the other of the rotors is given a surface treatment (plating process) to be coated with a hard material of appropriate thickness.

PRIOR ART LITERATURES

Patent Literatures

Patent Literature 1: Japanese Utility Model Application Publication No. Sho 63-202794

Patent Literature 2: Japanese Patent Application Publication No. Hei 3-168382

Although hardness of tooth surfaces (contacting surfaces) of both of the inner rotor and the outer rotor of a gerotor pump is improved with the steam treatment, embrittlement and delamination of the tooth surfaces have been observed in an operating status under the application of larger impulsive loads on the tooth surfaces. In consideration of this, an attempt has been made that neither of the tooth surfaces (contacting surfaces) is given the steam treatment. In this case, it has been found that although the tooth surfaces do not wear during a normal operation of the pump, adhesive wear occurs on some areas of the tooth surfaces during a continuous actuation of the pump, depending on a temperature range and/or a rotational speed range.

SUMMARY OF THE INVENTION

The present invention has been made to solve the above problems, and thus provide a gear pump with which the problems of delamination and adhesive wear of tooth surfaces can be solved.

In order to accomplish the above-mentioned object, the present invention provides an improved gear pump which comprises: a driving rotor (2) that is driven by a driving source; and a driven rotor (3) that is driven by the driving rotor, wherein the driving rotor and the driven rotor are rotated while meshing with each other to transfer working fluid, and wherein only one of the driving rotor and the driven rotor is given a steam treatment while the other remains untreated. Note that the reference numerals in parenthesis are exemplarily given only for the purpose of referring to the reference numerals of corresponding elements in an embodiment that will be described below.

According to the present invention, one of the driving rotor and the driven rotor of the gear pump is given the steam treatment while the other remains untreated. The desired hardness of the tooth surface (contacting surface) of the one rotor can be therefore secured while the hardness of the tooth surface (contacting surface) of the other rotor is relatively low. As a result, possible occurrence of adhesive wear and delamination of a tooth surface is reduced. For example, as for adhesive wear, because the adhesion temperature of members of different materials in contact with each other is high, there is a less incidence of adhesion, and thus, the occurrence of adhesive wear is reduced. Also, as for delamination of a tooth surface, because one of the driving rotor and the driven rotor, which is more likely to be subject to delamination of a tooth surface than the other, remains untreated, embrittlement of the tooth surface is prevented, and thus, the occurrence of delamination of the tooth surface can be reduced. In a preferred embodiment, because either the driving rotor or the driven rotor is appropriately selected to be given the steam treatment, an appropriate effect can be obtained.

EMBODIMENT OF THE INVENTION

Figure 1:
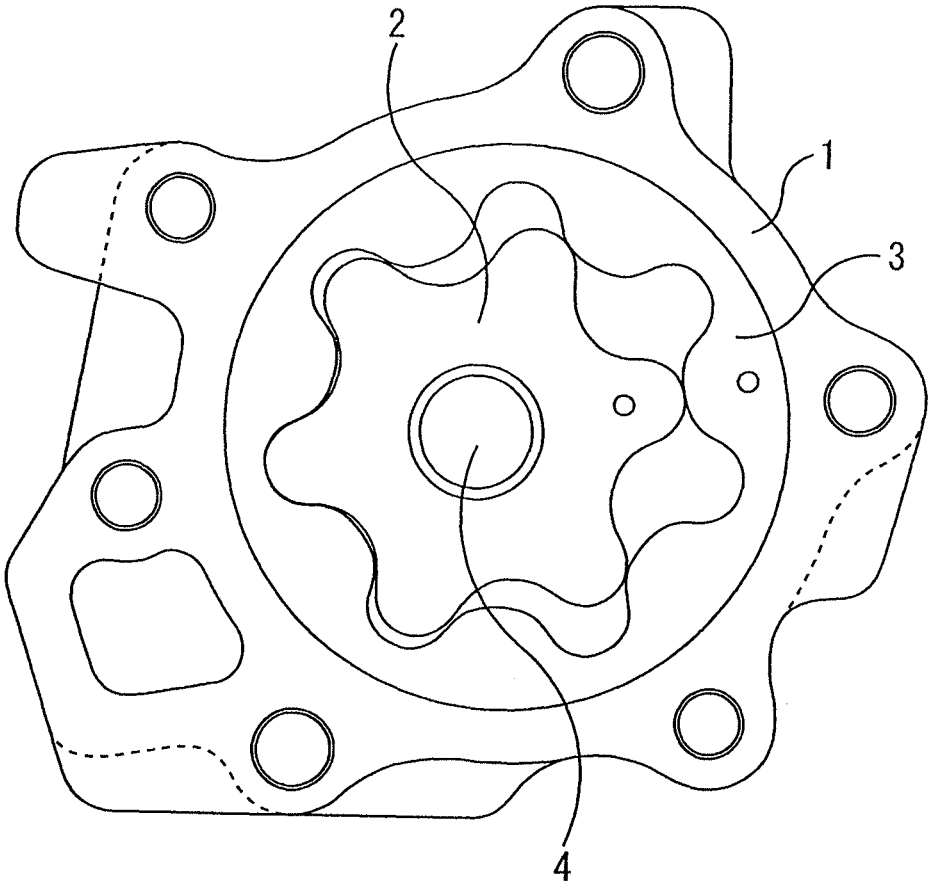
FIG. 1 is a plan view, schematically showing a gerotor pump that is used as an oil pump for an automatic transmission as an embodiment of the present invention.

Referring to FIG. 1, a gerotor pump includes an inner rotor (driving rotor) 2 and an outer rotor (driven rotor) 3 that are housed in an oil pump body 1. As conventionally known, the inner rotor 2 has outer teeth in an appropriate number "n" on its outer periphery, a drive shaft 4 is joined with an inner periphery of the inner rotor 2 with a spline, a claw, and so on, the outer rotor 3 has inner teeth in a larger number "n+1" than "n" on its inner periphery, and the outer teeth and the inner teeth are meshed in such an arrangement that the outer rotor 3 is off-center from the center of the inner rotor 2 and incorporated in the oil pump body 1. In an oil pump for an automatic transmission, any shaft such as a transmission input shaft, that performs rotational motion, is used as the drive shaft 4.

As conventionally known, the inner rotor 2 is rotationally driven by rotation of the drive shaft 4, followed by rotation of the outer rotor 3, and the outer teeth of the inner rotor 2 mesh with the inner teeth of the outer rotor 3 for rotation to pump a hydraulic oil (working fluid) in a cavity that is defined between the outer teeth and the inner teeth. Because the outer rotor 3 is off-center from the center of the inner rotor 2, and also because the numbers of teeth of both of the rotors differ from each other, a volume of the cavity between tops and bottoms of a pair of meshed teeth continuously changes, and accordingly, a pumping action is performed in which the hydraulic oil (working fluid) is suctioned into the cavity from an unillustrated suction port and is discharged to an unillustrated discharge port from the cavity.

The inner rotor 2 and the outer rotor 3 are made of an iron-based sintered metal. In configuring the gear pump according to the present invention, one of the inner rotor 2 and the outer rotor 3 is given a steam treatment (heat treatment at approximately 500 degrees Celsius, for example), and the other is untreated (ungiven the steam treatment). Accordingly, a surface of the one rotor (2 or 3) with the steam treatment is formed with an oxide film that increases hardness of the surface, thereby to improve abrasive resistance. Meanwhile, because a surface of the other rotor (3 or 2) that is ungiven the steam treatment is not formed with the oxide film, the surface itself cannot be hardened. However, because the hardness of the tooth surface (contacting surface) of the one rotor (2 or 3) becomes relatively high with this treatment, and also because the hardness of the tooth surface (contacting surface) of the other rotor (3 or 2) in contact with the tooth surface (contacting surface) of the one rotor (2 or 3) becomes relatively low, there is a less incidence of delamination of the tooth surfaces when compared to a case where both of the tooth surfaces have a high hardness. In addition, because the hardness of the one tooth surface (contacting surface) is relatively higher than the other, the occurrence of adhesive wear of the tooth surfaces can also be reduced.

As for inhibition of adhesive wear, when it is considered that there is less incidence of adherence with contact of different materials due to an increase in an adhesive temperature, the same effect of inhibition of adhesive wear can be expected whether the steam treatment is given to either the inner rotor 2 or the outer rotor 3.

Figure 2:
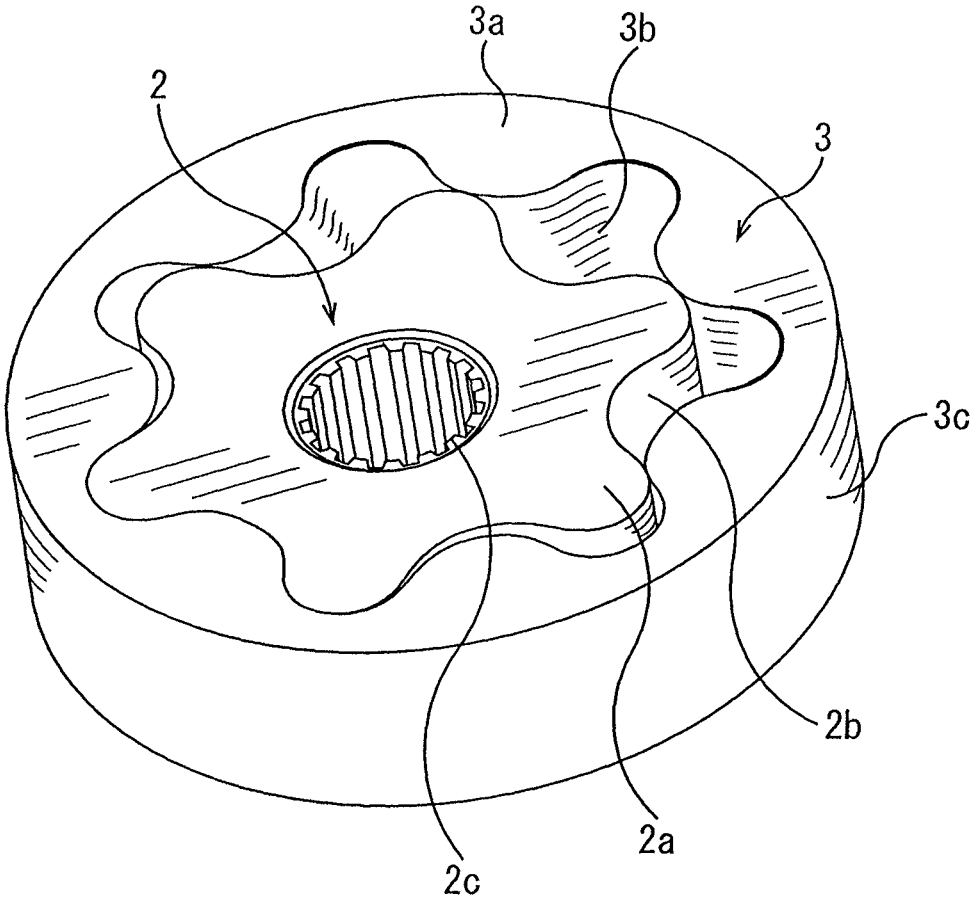
FIG. 2 is a perspective view, showing an inner rotor part and an outer rotor part in FIG. 1.

As for inhibition of delamination of a tooth surface, it is considered to be effective that the steam treatment is given to a rotor with a larger number of teeth, that is, the outer rotor 3. After the steam treatment the delamination of a tooth surface occurs when a high load acts on contacting portions of the tooth surfaces of the inner rotor and the outer rotor, causing an excessive surface pressure. Because the number of contacts of each teeth in a certain actuating period is larger for the inner rotor than for the outer rotor due to the less number of the teeth, the inner rotor is more likely to be subject to contact fatigue and thus to delamination of the tooth surface. Therefore, when a propriety is set to prevention of delamination of a tooth surface of a rotor, the outer rotor 3 with more number of teeth should be given the steam treatment while the inner rotor 2 with less number of teeth remains untreated. Accordingly, there is a less incidence of delamination of the tooth surface on the inner rotor 2. Also, in this case, it is expected that slight deformation on the tooth surface of the inner rotor 2 that is not given the steam treatment reduces a contacting pressure against the outer rotor 3, and accordingly, there is also a less incidence of delamination of the tooth surface on the outer rotor 3 that is given the steam treatment. If the entire outer rotor 3 is given the steam treatment, then films on both of side surfaces 3*a* of the outer rotor 3 are usually removed by a subsequent grinding process, and the films formed by the steam treatment remain on a tooth surface 3*b* on a inner peripheral side and an outer periphery 3*c* (FIG. 2). According to the present invention, the purpose can be achieved as long as the tooth surface 3*b* on the inner peripheral side of the outer rotor 3 is given the steam treatment.

On the other hand, when it is considered to improve abrasive resistance of an engaging and contacting portion between the inner periphery of the inner rotor 2 and the drive shaft 4, the inner rotor 2 should preferably be given the steam treatment while the outer rotor 3 remains untreated. In this case, the entire inner rotor 2 is given the steam treatment, films on both of side surfaces 2*a* of the inner rotor 2 are removed by the subsequent grinding process, and the films formed by the steam treatment remain on a tooth surface 2*b* on an outer peripheral side and an inner periphery 2*c* (FIG. 2). That is, as a matter of practice, the tooth surface 2*b* on the outer peripheral side and the inner periphery 2*c* of the inner rotor 2 are given the steam treatment. Accordingly, because the tooth surface 2*b* on the outer peripheral side of the inner rotor 2 can be hardened, and also because the inner periphery 2*c* can be hardened, there is also an advantage that it is possible to ensure abrasive resistance of the inner periphery 2*c* that engages with/contacts the drive shaft 4.

As it has been described so far, appropriate one of the inner rotor (driving rotor) 2 and the outer rotor (driven rotor) 3 should be given the steam treatment, depending on a technological purpose to be achieved.

In the above embodiment, a description has been made to a gerotor pump; however, the present invention is also applicable to an external gear pump.

What is claimed is:

1. A gear pump comprising:

a driving rotor that is driven by a driving source; and a driven rotor that is driven by the driving rotor, wherein the driving rotor and the driven rotor are rotated while meshing with each other to transfer working fluid, wherein the driving rotor includes fewer teeth than the driven rotor, and the driven rotor has steam treatment performed thereon, whereas the driving rotor has no steam treatment performed thereon, and wherein a tooth surface on an inner peripheral surface of the driven rotor has remaining thereon a film layer formed through the steam treatment, and both side surfaces of the driven rotor have removed therefrom film layers formed through the steam treatment.

* * * * *